US006807922B1

(12) United States Patent
Bills et al.

(10) Patent No.: US 6,807,922 B1
(45) Date of Patent: Oct. 26, 2004

(54) WATERCRAFT SHROUD

(75) Inventors: Ron Alan Bills, Maple Plain, MN (US); Robert Brady, Sarasota, FL (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/379,577

(22) Filed: Feb. 28, 2003

Related U.S. Application Data

(63) Continuation-in-part of application No. 29/169,853, filed on Oct. 28, 2002, now Pat. No. Des. 478,035.

(51) Int. Cl.[7] ..... B63B 35/86
(52) U.S. Cl. ..... 114/363; 114/55.55
(58) Field of Search ..... 114/363, 55.55; D12/317

(56) References Cited

U.S. PATENT DOCUMENTS 4,629,434 A * 12/1986 Monreal ..... 441/65
4,678,444 A * 7/1987 Monreal ..... 441/65
5,355,826 A * 10/1994 Hattori et al. ..... 114/55.57
D359,469 S * 6/1995 Yoshida et al. ..... D12/307
5,447,116 A 9/1995 Kobayashi ..... 114/363
6,035,802 A 3/2000 Lussier ..... 114/363
6,158,378 A 12/2000 Tsumiyama et al. ..... 114/363

* cited by examiner

*Primary Examiner*—S. Joseph Morano
*Assistant Examiner*—Lars A. Olson
(74) *Attorney, Agent, or Firm*—Fredrikson & Byron, P.A.

(57) ABSTRACT

A personal watercraft having a shroud portion. The watercraft includes a hull formed from an upper portion secured over a bottom hull. The hull defines an engine compartment sized to contain an internal combustion engine for powering a jet propulsion unit. The jet propulsion unit includes a steerable water discharge nozzle. The upper portion includes a straddle-type seat, a top deck, and a shroud, where a portion of the sidewalls of the shroud curve inward to form pockets at a point generally aligned with the knees of an operator seated on the personal watercraft.

24 Claims, 5 Drawing Sheets

WATERCRAFT SHROUD

CROSS REFERENCE TO RELATED APPLICATION

The present application is a continuation in part of U.S. design patent application Ser. No. 29/169,853, filed Oct. 28, 2002, and U.S. Pat. No. 0,478,035, and hereby incorporated by reference.

FIELD OF THE INVENTION

This invention is related to a watercraft such as a personal watercraft and more particularly to an improved shroud therefore.

BACKGROUND

Personal watercrafts have become increasingly popular in recent years. A personal watercraft, also known as a "jet ski", typically has a bottom hull, handle bars for steering, a tunnel within the bottom hull, a jet pump located within the bottom tunnel, and an engine within the hull under the top deck for driving the jet pump. The jet pump typically pulls in water from the front of the tunnel under the boat, and discharges the water at high velocity through a steerable nozzle at the rear of the boat. The handlebars are typically coupled to the nozzle, which is the steering mechanism for the personal watercraft. The watercraft commonly has a straddle-type seat and foot wells disposed on either side of the seat.

The top deck often includes a shroud mounted forward of the seat and on top of the top deck to house the steering column and other instruments. A fore portion of the top deck includes a hinged cover or hood that typically covers either a storage compartment or engine access port. Likewise, the shroud may include a compartment for storing tools or personal effects.

Personal watercrafts are often driven aggressively and at high rates of speed while maneuvering significantly. The fashion in which personal watercrafts are operated often makes it difficult for the operator to stabilize him or herself on the watercraft.

A number of attempts have been made to assist personal watercraft operators to stabilize themselves during ride. For example, specialized gloves with padded palms designed to allow for a secure grip on the handlebars or hand grips are an example of an accessory developed to alleviate the problem of rider stabilization.

A number of features to be added to the body of the personal watercraft have also been used to stabilize the operator and/or rider. For example, U.S. Pat. No. 6,035,802 discloses the use of a back of the leg support releasably attached to the foot well of a personal watercraft to stabilize the legs of a rider during operation.

Another example includes the extension of the cushioning of the seat down the vertical sides of the seat such that the operator or rider may apply pressure with his or her thighs against the vertical sides to facilitate stabilization.

While each of the aforedescribed attempts has assisted operators stabilize themselves during operation, a need remains for the facilitation of comfortably stabilizing the operator while maneuvering a personal watercraft.

SUMMARY OF THE INVENTION

The present invention provides a shroud for a personal watercraft. According to one aspect, there is provided a jet-propelled personal watercraft comprising a hull including a bottom hull and an upper portion secured over the bottom hull. The hull defines an engine compartment sized to contain an internal combustion engine for powering a jet propulsion unit. The jet propulsion unit includes a steerable water discharge nozzle.

The upper portion of the watercraft has a raised, longitudinally extending seat adapted to accommodate an operator in straddle fashion. The upper portion further includes a top deck portion and a shroud portion. The shroud portion is disposed forward of the seat and over the top deck. The shroud portion includes first and second sidewalls. A portion of the first and second sidewalls curve inward to form pockets at a point generally aligned with knees of an operator seated on the personal watercraft.

According to another aspect, there is provided a jet-propelled personal watercraft comprising a hull including a bottom hull and an upper portion secured over the bottom hull. The hull defines an engine compartment sized to contain an internal combustion engine for powering a jet propulsion unit. The jet propulsion unit includes a steerable water discharge nozzle.

The upper portion of the watercraft has a raised, longitudinally extending seat adapted to accommodate an operator in straddle fashion. The upper portion further includes a top deck portion and a shroud portion, the shroud portion being disposed over the top deck and housing steering controls that control the steerable water discharge nozzle. The shroud portion of the upper portion includes right and left sidewalls. A portion of the right and left sidewalls taper downwardly inwardly from a top portion of the shroud portion in an area generally aligned with knees of an operator seated on the personal watercraft.

According to another aspect, there is provided a jet-propelled personal watercraft comprising a hull including a bottom hull and an upper portion secured over the bottom hull. The hull defines an engine compartment sized to contain an internal combustion engine for powering a jet propulsion unit. The jet propulsion unit includes a steerable water discharge nozzle.

The upper portion of the watercraft has a raised, longitudinally extending seat adapted to accommodate an operator in straddle fashion. The upper portion further includes a shroud portion housing disposed below steering controls that control the steerable water nozzle. The shroud portion includes first and second sidewalls with a portion of the first and second sidewalls curving inward to form pockets at a point generally aligned with knees of an operator seated on the personal watercraft.

DETAILED DESCRIPTION OF THE PREFERRED EMBODIMENTS

The following detailed description should be read with reference to the drawings, in which like elements in different drawings are numbered identically. The drawings, which are not necessarily drawn to scale, depict selected embodiments and are not intended to limit the scope of the invention. Several forms of the invention will be shown and described, and other forms will now be apparent to those skilled in the art. It will be understood that embodiments shown in drawings and described are merely for illustrative purposes and are not intended to limit the scope of the invention as defined in the claims that follow.

Figure 1:
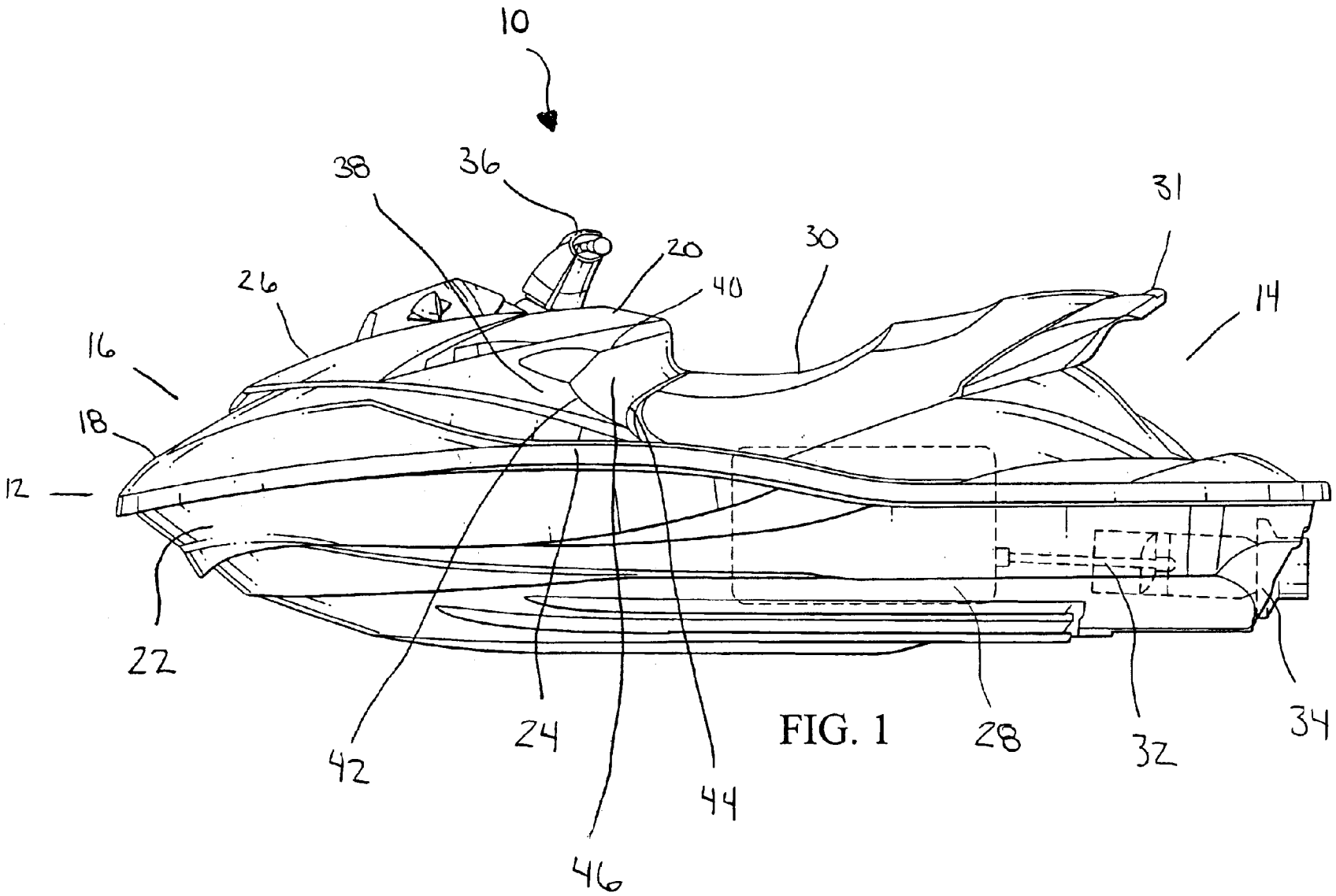
FIG. 1 is a schematic of a personal watercraft with the shroud of the present invention.

FIG. 1 illustrates a generally a watercraft 10 having the shroud of the present invention. Watercraft 10 has generally a front or bow 12 and a rear or stern 14 and includes an upper portion 16 that includes a top deck or top deck portion 18 and shroud or shroud portion 20. The top deck 18 is secured to a bottom hull 22 along an overlapping portion covered with a rub rail 24 in the embodiment illustrated, forming a hull. A hood 26 may also be seen, joined to the top deck 18. The hull formed by the bottom hull 22 and top deck 18 define a compartment sized to house an internal combustion engine 28 for powering the watercraft 10 and may also include one or more storage compartments (not shown), depending on the size and configuration of the watercraft.

The deck portion 18 also has a raised, longitudinally extending seat 30 adapted to accommodate one or more riders seated in straddle fashion. A grab handle 31 is disposed transversely across the rear of the seat 30.

Engine 28 powers a jet propulsion unit 32, typically mounted in a tunnel at the bottom rear portion of the watercraft, all shown in phantom in FIG. 1. Jet propulsion unit 32 includes a steerable water discharge nozzle 34 that is operatively connected to a set of handlebars 36 to facilitate steering of the watercraft by the operator. Handlebars 36 typically mount through a top portion of a shroud 20. The connection between handlebars 36 and discharge nozzle 34 may be of any suitable type, and typically includes mechanical linkages including a control cable (not shown). If desired, an electronic connection could also be utilized.

The upper portion 16 includes a shroud 20 that is disposed forward of the seat 30, below the handlebars 36 and on top of the top deck 18 to house the steering column and other instruments (not shown). The shroud 20 may be comprised of separate components that are mounted on the top deck 18. It is also contemplated that the shroud 20 may be an integrated portion of the top deck portion 18 that forms the upper portion 16.

Figure 2A:
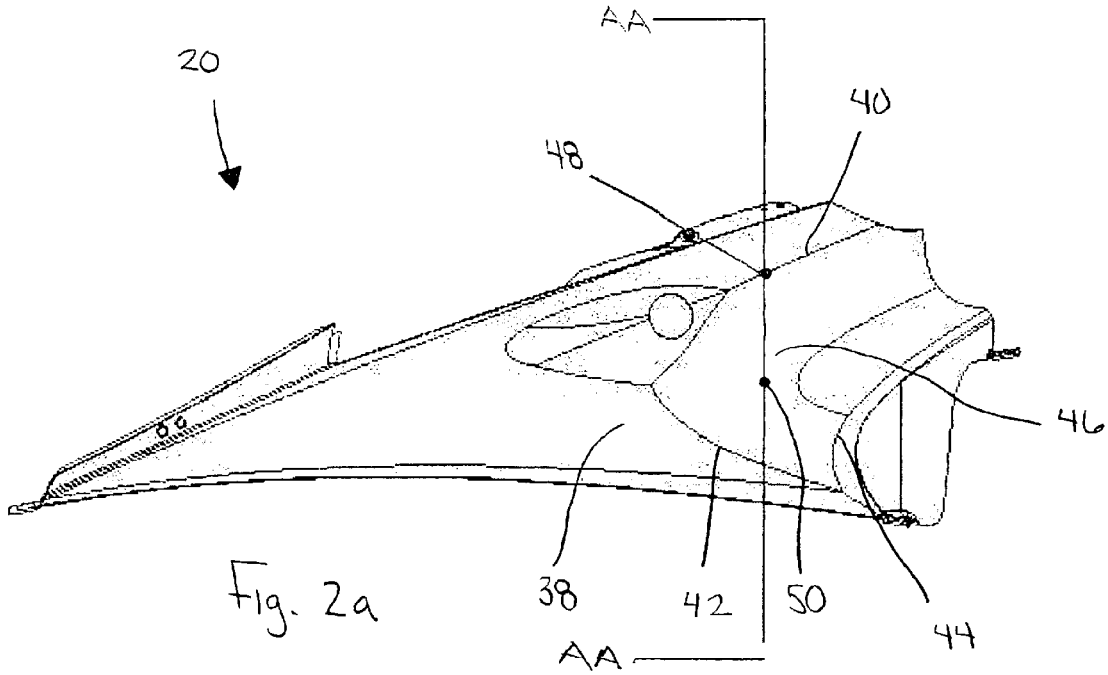
FIG. 2*a* is a side view of a shroud formed separately from the top deck according to a preferred embodiment.
Figure 2B:
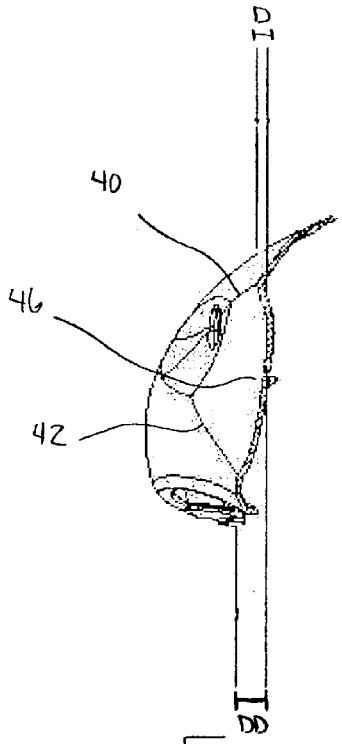
FIG. 2*b* is a cross section taken through the line AA in FIG. 2*a*.

As illustrated in FIG. 2*a*, shroud includes two generally vertical sides 38. Only one vertical side may be seen in the side view illustrated in FIG. 2*a*, however it is to be assumed that the opposite side is generally a mirror image (other that not having a recess for a reverse gate actuator) and need not be separately described. In accordance with one preferred embodiment, the first and second vertical sides 38 include a top edge 40, a front edge 42 and a bottom edge 44. The first and second vertical sides 38 curve laterally inward from the top, front, and bottom edges adjacent to the forward portion of the seat (shown in FIG. 1). The vertical sidewalls 38 taper downwardly inwardly from the top edge 40, rearwardly inwardly from the front 42, and upwardly inwardly from the bottom edge 44. The laterally inward curves originated at the top, front, and bottom edges form a concave pocket 46 at a position in general alignment with the knees of an operator seated upon the seat (shown in FIG. 3) in straddle As shown in FIG. 2*b*, the depth of the concave pocket is sufficient to accommodate the knees of an operator. The cross section (taken from the Line AA in FIG. 2*a*) depicted in FIG. 2*b* generally depicts the location at which the knee of an operator will contact the pocket of the shroud. The depth of the pocket can be measured as the horizontal distance ("D") (as measured laterally in a direction perpendicular to a vertical plane containing the watercraft longitudinal centerline) from a point along the top edge 40 to a point within the pocket 46. For example, the depth from the top edge, as measured as the horizontal distance ("D") between a line dropped from the point 48 above the rider's knee area on the top edge 40 and a point 50 corresponding to the deepest point in the pocket, may range from 0.4 to 1.5 inches. In a preferred embodiment, the distance is 0.4 inches. The depth may also similarly be defined as the horizontal distance "DD" between the bottom edge 44 and the deepest point in the pocket. This distance may range from 1.0 to 3.0 inches. In a preferred embodiment, the distance is 1.2 inches.

It will be appreciated that the geometry of the curve or pocket may vary. For instance, in an alternate embodiment, the vertical sides may taper laterally inward from the top edge 40 only, forming a mushroom-shaped geometry. Alternatively, the vertical sides may taper laterally inward from the top edge 40 and the front edge 42. In yet another alternative embodiment, the vertical sides may taper laterally inward from the top edge 40 and bottom edge 44.

The inwardly curving edges 40, 42, 44 provide a pocket 46 in the vertical sides 38 of the shroud 20 against which an operator may apply positive pressure with his or her knees to stabilize him or herself during operation of the watercraft.

Figure 3:
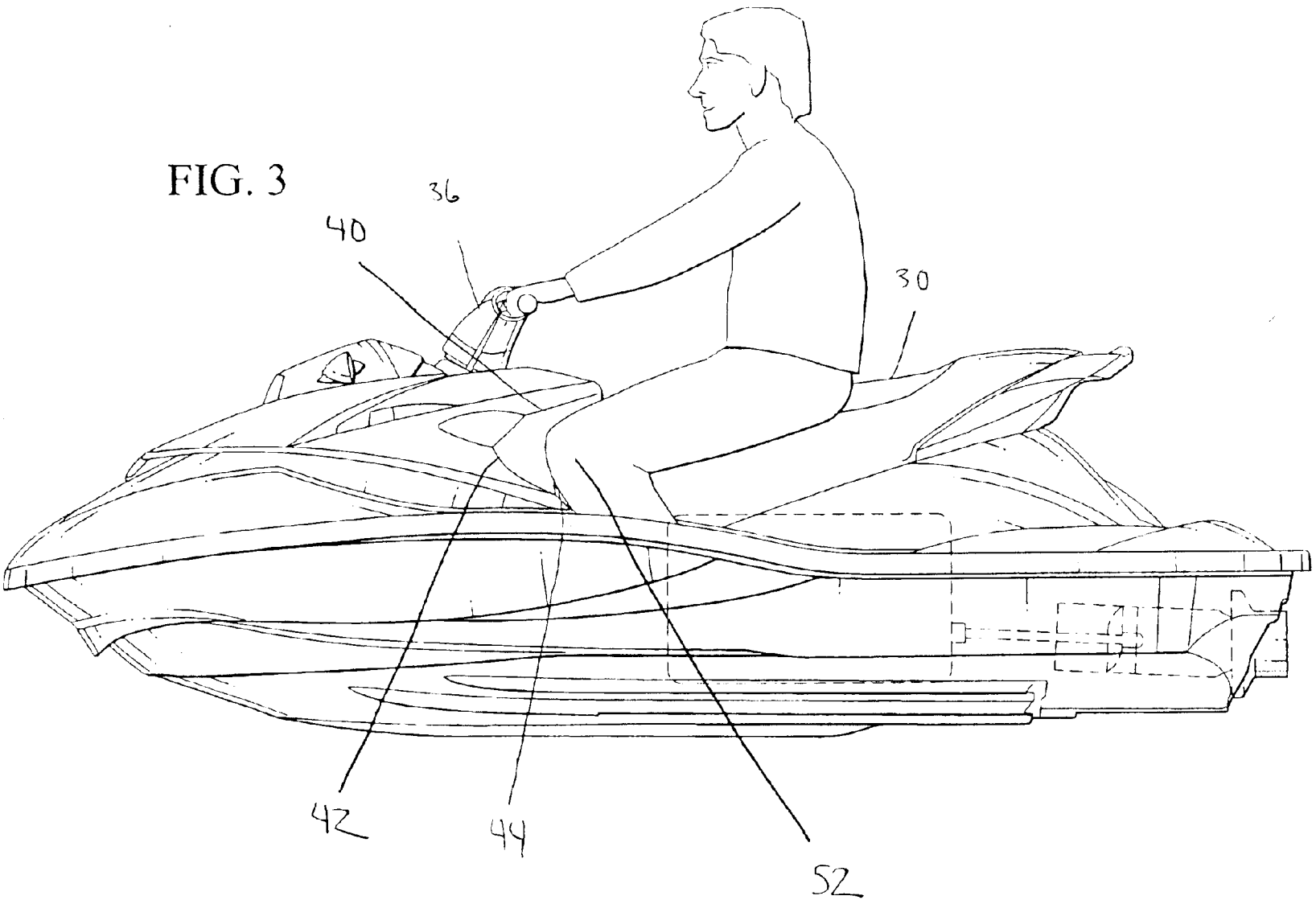
FIG. 3 is a side view of a rider seated on a personal watercraft equipped with a shroud according to a preferred embodiment of the present invention.

FIG. 3 shows an operator utilizing the pocket (concealed by the knees of the rider in FIG. 3) formed by the inwardly curved vertical sides of the shroud 20 according to a preferred embodiment to stabilize him/herself during operation. As is illustrated, inwardly tapering edges of the vertical sides of the shroud form a pocket (concealed by the knees of the rider in FIG. 3) that accommodates the knees 52 of the operator. During operation, the operator may apply positive force with his or her knees to stabilize his or her body on the watercraft during aggressive maneuvering or ordinary operation.

As can be seen, the top edge 40 of the vertical edge helps the operator maintain his or her stability by maintaining the position of the legs and feet against forces that would normally cause the legs to move upwardly, for example, when the watercraft planes off the surface of the water and returns to the surface or when wakes are crossed. Similarly, the operator may brace his or her knees against the curve formed by the laterally inward taper initiating at the front edge 42. This portion of the pocket helps to prevent the operator from sliding forward on the seat 30 towards the handlebars 36. Finally, the curve initiating at the bottom edge 44 functions to cradle the knee of an operator so that all edges combine to improve operator stabilization during operation of the watercraft.

Figure 4:
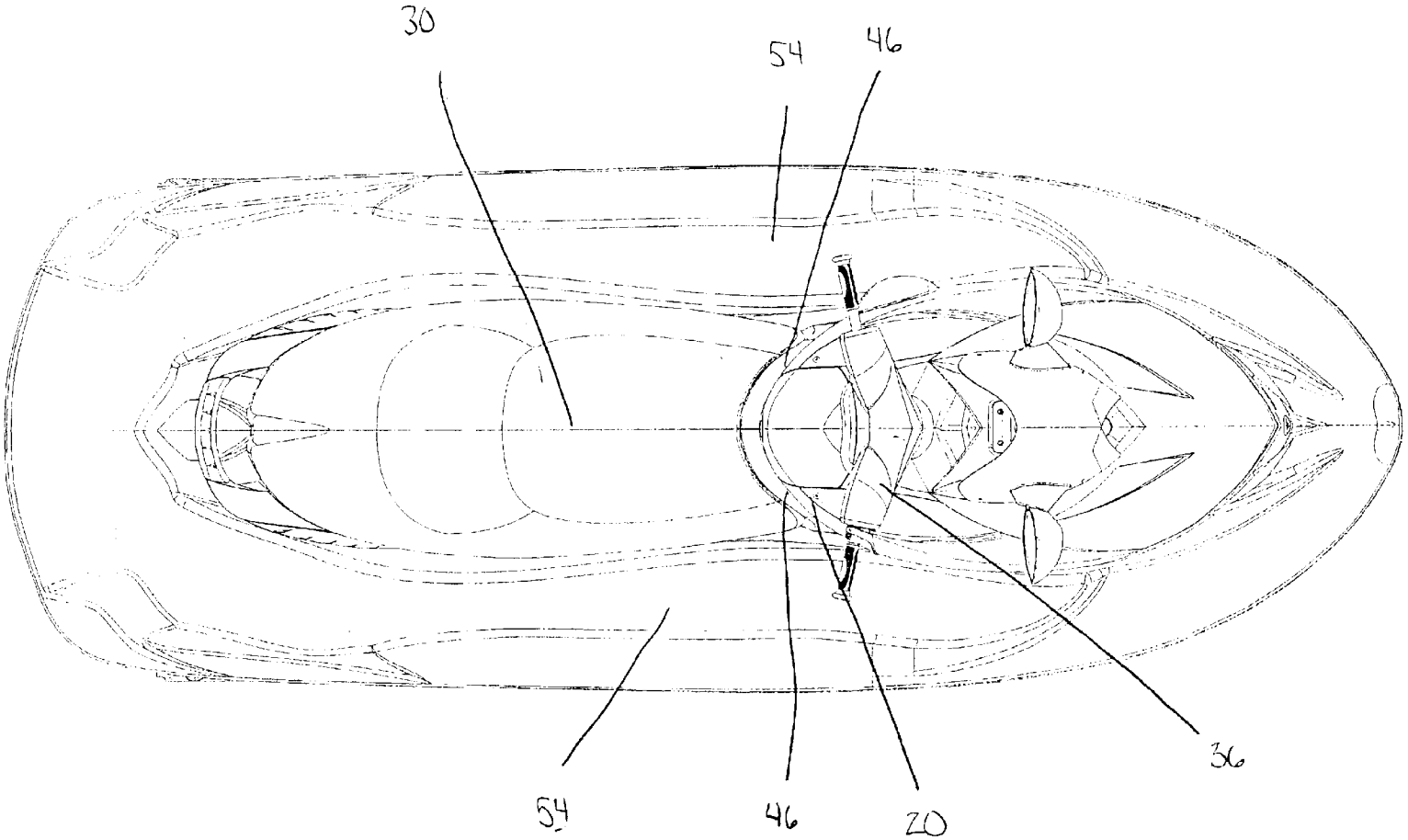
FIG. 4 is a top view of the personal watercraft shown in FIG. 1.

The top view of a watercraft with a shroud according to a preferred embodiment of the present invention is shown in FIG. 4. FIG. 4 illustrates the relative positions of the foot wells 54, seat 30, pockets 46 in the shroud 20, shroud 20, and handlebars 36 that allows the rider to utilize the shroud for stabilization. As is shown, the shroud may be positioned such that the pockets 46 in the shroud 20 are at a level above the foot wells 54 and forward of the seat 30 so that the operator's knees align with the pockets 46 while seated in straddle fashion on the seat 30 as illustrated in FIG. 2.

The shroud may be formed of fiberglass, plastic or any other suitable material. The shroud may be formed separately from the top deck by methods known to those skilled in the art. It should be understood, however, that some or all of the shroud may be integrated as part of the top deck without departing from the scope of the present invention.

Figure 5:
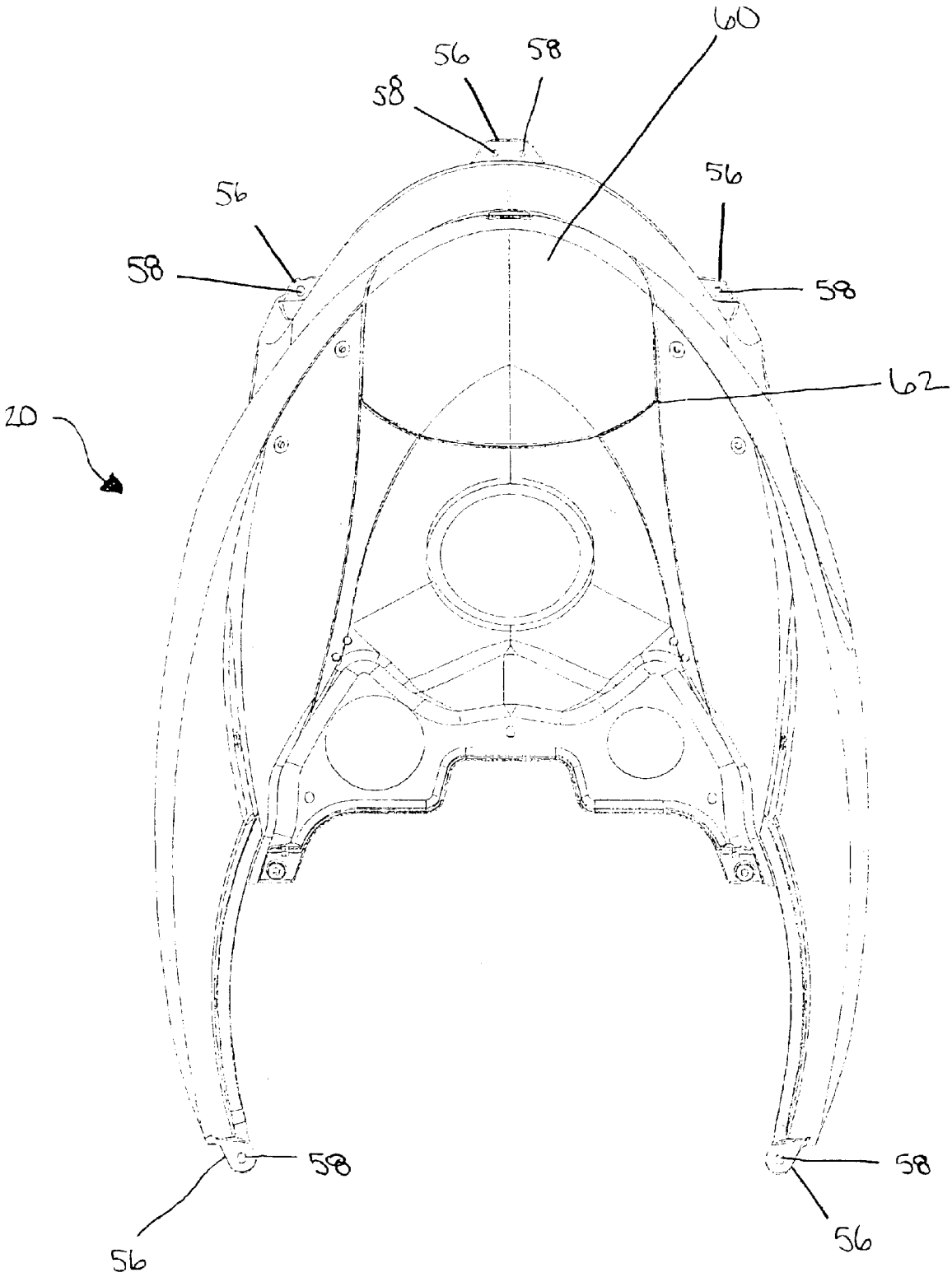
FIG. 5 is top view of the personal watercraft shroud according to a preferred embodiment of the present invention.

FIG. 5 depicts a shroud formed separately from the top deck in accordance with a preferred embodiment. Shroud 20 may be formed with flanges 56 extending from the fore and aft sides. Flanges 56 include bores 58 formed therein to facilitate attachment to the top deck. The shroud 20 may be attached by threading bolts (not shown) through bores 58 in flanges 56 to be threadedly received in bores formed in the top deck (not shown), or by any other conventional means. It can be appreciated that flanges 56 may be positioned in various locations on the shroud 20 to facilitate attachment to the top deck. Alternatively, the attachment points may be concealed by being formed on the underside (not shown) of the shroud 20.

In accordance with yet another aspect, the shroud may be formed of a size and configuration to accommodate the formation of a compartment 60 for storing tools or other personal effects. As is shown is FIG. 5, the compartment is covered with a hinged cover 62 and may be formed in the upper portion of the shroud 20 that is adjacent to the seat so that the operator can easily access the compartment 60. Accordingly, the shroud 20 may be configured in size and shape such that compartment is in a plane substantially level with the arms and hands of an operator seated on the watercraft.

While preferred embodiments of the present invention have been described, it should be understood that various changes, adaptations, and modifications may be made without departing from the spirit of the invention and the scope of the appended claims.

What is claimed is:

1. A jet-propelled personal watercraft comprising:

a hull including a bottom hull and an upper portion secured over the bottom hull, the hull defining an engine compartment sized to contain an internal combustion engine for powering a jet propulsion unit, the jet propulsion unit including a steerable water discharge nozzle, the upper portion having a raised, longitudinally extending seat adapted to accommodate an operator in straddle fashion, the upper portion including a top deck portion and a shroud portion, the shroud portion being disposed forward of the seat and over the top deck, the shroud portion including first and second sidewalls, and a portion of the first and second sidewalls curving inward to form pockets at a point generally aligned with knees of an operator seated on the personal watercraft.

2. The personal watercraft of claim 1, wherein the shroud portion houses steering controls that control the water discharge nozzle.

3. The personal watercraft of claim 1, wherein the portion of the first and second sidewalls curve laterally inward to form the pockets.

4. The personal watercraft of claim 1, wherein the first and second sidewalls taper downwardly inwardly from a top of the shroud portion to form the pockets.

5. The personal watercraft of claim 1, wherein the portions of the first and second sidewalls each taper rearwardly inwardly to form the pockets.

6. The personal watercraft of claim 4, wherein the first and second sidewalls taper downwardly inwardly from the top of the shroud portion by at least 0.4 inches.

7. The personal watercraft of claim 4, wherein the first and second sidewalls taper downwardly inwardly from the top of the shroud portion by an amount of about 0.4 to 1.5 inches.

8. The personal watercraft of claim 5, wherein the portions of the first and second sidewalls each taper upwardly inwardly from the top deck portion to form the pockets.

9. The personal watercraft of claim 1, wherein the portions of the first and second sidewalls catch taper upwardly inwardly to form the pockets.

10. The personal watercraft of claim 1, wherein the shroud portion includes a hinged cover for a storage compartment.

11. The personal watercraft of claim 1, wherein the shroud portion is formed separately from the top deck portion.

12. The personal watercraft of claim 11, wherein the shroud portion includes mounting means for mounting the shroud to the top deck.

13. The personal watercraft of claim 12, wherein the mounting means include flanges formed on the fore and aft sides of the shroud portion, the flanges including bores therein to receive a bolt, the bores substantially aligned with threaded bores formed on the top deck.

14. A jet-propelled personal watercraft comprising:

a hull including a bottom hull and an upper portion secured over the bottom hull, the hull defining an engine compartment sized to contain an internal combustion engine for powering a jet propulsion unit, the jet propulsion unit including a steerable water discharge nozzle, the upper portion having a raised, longitudinally extending seat adapted to accommodate an operator in straddle fashion, the upper portion including a top deck portion and a shroud portion, the shroud portion being disposed over the top deck and housing steering controls that control the steerable water discharge nozzle, the shroud portion including right and left sidewalls, a portion of the right and left sidewalls tapering downwardly inwardly from a top portion of the shroud portion in an area generally aligned with knees of an operator seated on the personal watercraft.

15. The jet-propelled personal watercraft of the claim 14, wherein the portions of the first and second sidewalls taper downwardly inwardly from the top portion of the shroud by at least 0.4 inches.

16. The jet-propelled personal watercraft of claim 14, wherein the portions of the first and second sidewalls each taper upwardly inwardly to form concave pockets.

17. The jet-propelled personal watercraft of claim 14, wherein the portions of the first and second sidewalls taper rearwardly inwardly.

18. The jet-propelled personal watercraft of claim 14, wherein the shroud portion is formed separately from the top deck portion.

19. The jet-propelled personal watercraft of claim 14, wherein the shroud portion includes a hinged cover for a storage compartment.

20. A jet-propelled personal watercraft comprising:

a hull including a bottom hull and an upper portion secured over the bottom hull, the hull defining an engine compartment sized to contain an internal combustion engine for powering a jet propulsion unit, the jet propulsion unit including a steerable water discharge nozzle, the upper portion having a raised, longitudinally extending seat adapted to accommodate an operator in straddle fashion, the upper portion including a shroud portion housing disposed below steering controls that control the steerable water nozzle, the shroud portion including first and second sidewalls, and a portion of the first and second sidewalls curving inward to form pockets at a point generally aligned with knees of an operator seated on the personal watercraft.

21. The jet-propelled personal watercraft of claim 18, wherein the portions of the first and second sidewalls each taper downwardly inwardly from a top of the shroud portion to form pockets.

22. The jet-propelled personal watercraft of claim 19, wherein the portions of the first and second sidewalls taper downwardly inwardly from the top portion of the shroud by at least 0.4 inches.

23. The jet-propelled personal watercraft of claim 20, wherein the portions of the first and second sidewalls each taper upwardly inwardly to form the pockets.

24. The jet-propelled personal watercraft of claim 21, wherein the portions of the first and second sidewalls taper rearwardly inwardly to form concave pockets.

* * * * *